US006213316B1

(12) United States Patent
Gretz

(10) Patent No.: US 6,213,316 B1
(45) Date of Patent: Apr. 10, 2001

(54) CLIP STRIP

(75) Inventor: Thomas J. Gretz, Clarks Summit, PA (US)

(73) Assignee: Arlington Industies, Inc., Scranton, PA (US)

( * ) Notice: Subject to any disclaimer, the term of this patent is extended or adjusted under 35 U.S.C. 154(b) by 0 days.

(21) Appl. No.: 09/473,433

(22) Filed: Dec. 29, 1999

(51) Int. Cl.[7] ..... A47F 7/00

(52) U.S. Cl. ..... 211/113; 211/85.15; 211/89.01; D6/514

(58) Field of Search ..... 211/113, 85.15, 211/87.01, 89.01, 71.01; D6/513, 514, 328; 248/316; 403/316, 315; 40/657, 658, 124

(56) References Cited

U.S. PATENT DOCUMENTS

D. 367,574 * 3/1996 Werner ..... D6/514
4,461,387 * 7/1984 Belokin, Jr. ..... 211/85.15
4,767,012 * 8/1988 Simmons ..... 211/113 X
5,339,967 * 8/1994 Valiulis ..... 211/113 X
5,967,341 * 10/1999 Werner ..... 211/85.15

* cited by examiner

*Primary Examiner*—Daniel P. Stodola
*Assistant Examiner*—Erica B Harris

(57) ABSTRACT

The clip strip comprises an integrally molded, one-piece merchandise display device capable of supporting a plurality of "heavy" product items, i.e., in excess of several pounds each. The clip strip comprises a backbone or primary supporting member having a mounting member extending from one side thereof near its upper end. A plurality of vertically arranged rigid upstanding hooks extend from the side thereof opposing that from which the mounting member extends. Each of the rigid upstanding hooks has a resilient downstanding flange extending thereabove from the backbone. This structural arrangement permits insertion of product for display onto the rigid upstanding hooks while permitting ready removal of displayed product therefrom by deflection of the downstanding flange without the possibility of accidental removal of an overlying displayed product item when a lower displayed item is removed. An upstanding flange extending from the upper extremity of the backbone permits attachment of a tag or other device that displays pricing or other information.

9 Claims, 1 Drawing Sheet

CLIP STRIP

FIELD OF THE INVENTION

The present invention relates to merchandise display devices and more particularly to such devices that are commonly referred to as "clip strip" merchandise hangers for the presentation and display of a plurality of individually wrapped or packaged items usually as impulse purchase items.

BACKGROUND OF THE INVENTION

Merchandising strip devices are well known in the art to support volumes of generally small, high-volume merchandise in addition to those that can be carried by the conventional shelving. Such devices are particularly well suited for the display and presentation of impulse and point-of-purchase items.

To meet the variety of needs and desires for such clip strip display devices, a broad spectrum of such devices have been designed, manufactured and sold.

Among the many strip merchandising devices that have been suggested is that described in U.S. Pat. No. 5,386,916, to Valiulis that describes an adjustable strip merchandising device comprising an elongated plastic strip that is holed at an upper end thereof so that the strip may be vertically suspended from an existing shelf and a plurality of individual sections that are divided by transversely extending score lines that permit sections of the strip to be folded and reattached to the suspending member. Merchandise display is provided by a plurality of individual axially spaced suspension hooks that face upwardly and are sandwiched between downwardly facing and outer stabilizing fingers. U.S. Pat. Nos. 4,718,627, to Fast and 5,553,721 to Gebka, teach substantially identical variations of the clip strip arrangement of Valiulis.

Another common variety of clip strip, is that of the type taught by U.S. Pat. No. 4,767,012 to Simmons which describes a strip hanger specifically useful for supporting bags of potato chips and similar snack products and which includes an elongate base upon one side of which is formed in longitudinally extending fashion a plurality of individual lever portions. The lever portions are each provided by elongated members that are arranged at spaced apart distances from the base by a central pivot or fulcrum point. Pressing on a rear side of the lever causes a corresponding front side to pivot outwardly and an inwardly flanged portion to unseat from an associated groove defined within the face of the body. When released, the inwardly flanged portion pinches an edge of the product bag or the like allowing it to suspend from the strip.

Other similar such devices are described in U.S. Pat. Nos. 4,546,943 and 4,497,464 to Fast, and U.S. Pat. Nos. 5,683,003 to Gebka, 5,957,422 to Shea, 5,199,578 to Pendergraph et al, 4,573,590 to Ellis and U.S. Design Pat. Nos. Des. 367,574 to Werner and Des. 309,252 to Crowley.

While all of the foregoing provide useful merchandising display devices, they share a number of common shortcomings. Primarily, their design and construction does not permit the display of a plurality of items that individually weigh more than a few ounces. This is particularly true of the clip-type devices described by Simmons in U.S. Pat. No. 4,767,012, however most of the prior art devices lack the physical strength to support heavier sale items. Many of the devices provide open hooks for the attachment of the displayed items. This arrangement often results in the accidental removal of more than one display item particularly when the item removed lies below and overlying item much to the dismay, dissatisfaction and embarrassment of the customer.

SUMMARY OF THE INVENTION

The present invention provides an integrally molded, one-piece merchandise display device capable of supporting a plurality of "heavy" product items, i.e. in excess of several pounds each. The device of the present invention comprises a backbone or primary supporting member having a mounting member extending from one side thereof near its upper end. A plurality of vertically arranged rigid upstanding hooks extend from the side thereof opposing that from which the mounting member extends. Each of the rigid upstanding hooks has a resilient downstanding flange extending thereabove from the backbone. This structural arrangement permits easy insertion of product for display onto the rigid upstanding hooks while permitting ready removal of displayed product therefrom by deflection of the downstanding flange without the possibility of accidental removal of an overlying displayed product item when a lower displayed item is removed. An upstanding flange extending from the upper extremity of the backbone permits attachment of a tag or other device that displays pricing or other information.

DETAILED DESCRIPTION

Figure 1:
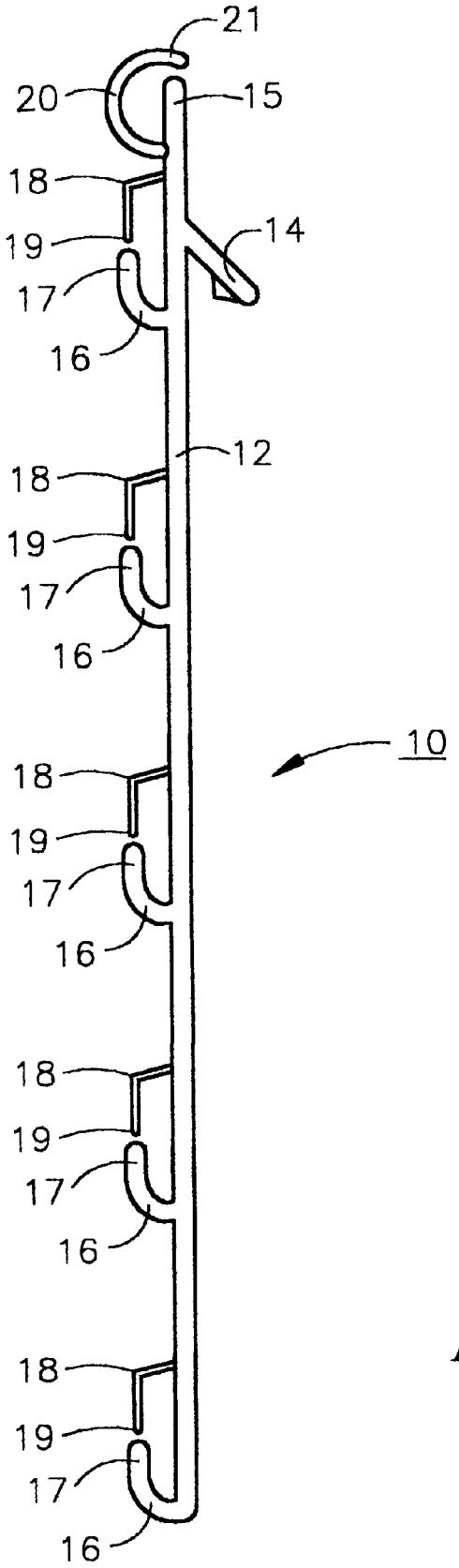
FIG. 1 is a perspective view of the clip strip device of the present invention.

According to the present invention, there is provided an improved integrally molded, one-piece clip strip merchandise display device demonstrating the capability of supporting substantially larger loads than prior art such devices while inhibiting the accidental removal of additional displayed product when a first product item is being removed therefrom. A mechanism is also provided for the attachment of a tagging device for the presentation of pricing or other product information.

As shown in FIG. 1, the clip strip 10 of the present invention comprises: 1) a backbone or primary support 12; 2) a mounting member 14; 3) a plurality of rigid upstanding display hooks 16 extending from backbone 12; 4) resilient downstanding flanges 18 each associated with an upstanding display hook 16; and 5) at the upper extremity of backbone 12 upstanding flange 20 for the attachment of a tag presenting pricing or other product information.

Clip strip 10 is preferably of a one-piece molded construction formed from a suitable polymeric material such as nylon, polyethylene, polypropylene, etc.

Mounting member 14 extends from the side of backbone 12 opposite that from which the plurality of rigid upstanding hooks 16 extends. Mounting member 14 may be of any suitable shape to engage an appropriate aperture in shelving or other display fixtures. Preferably, mounting member 14 extends downwardly, i.e., at an angle of less than about 90° at the upper end 15 of backbone 12 below upstanding flange 20 that provides a place to attach a tag or other device for presentation of pricing or other product information.

Rigid upstanding hooks 16 are spaced at any suitable interval vertically along the surface of backbone 12 opposite that from which mounting member 14 extends. The spacing of rigid upstanding hooks 16 will depend upon the particular product being displayed and their relative placement is in no way critical to the successful practice of the present invention. Rigid upstanding hooks 16 may also be of any suitable diameter or shape so long as they provide adequate engagement of apertures, slots, etc. in the packaging of or the product being displayed. According to a preferred embodiment of the present invention, all members of clip strip 10 except resilient flanges 18 are approximately round in cross-section to provide the maximum ease of handling and product attachment because of the rounded edges of such a configuration. Rigid upstanding hooks 16 should be of a size and shape to readily accept the product to be displayed and accordingly, their size and shape may be widely varied depending upon the final product application. Cross-sectional diameters for both backbone 12 and rigid upstanding hooks 16 of between about ⅛" and ½" have been found suitable for most applications although larger or smaller diameters are equally useful. As an example, a clip strip of the present invention was found capable of supporting in excess of five pounds on each of five rigid upstanding hooks when the backbone and hook diameter were both approximately ⅛". A radius of from about ¼" to about ¾" for rigid upstanding hooks 16 is preferred for most applications although larger or smaller radii can be used for a variety of product applications.

Important elements of the clip strip of the present invention are resilient downstanding flanges 18 and their location relative to rigid upstanding hooks 16. In order to obtain optimum utility from clip strip 10, it is necessary the extreme outer tips 19 of resilient flanges 18 address tips 17 of rigid upstanding hooks 16 in a manner such that a product or product package attached by engagement with rigid upstanding hook 16 cannot be readily removed therefrom without either tearing the packaging of the applied/attached product by, for example downward movement, or rearward deflection of resilient flange 18 such that tip 17 no longer addresses tip 19, and the product can be readily removed vertically from rigid hook 16. Stated more simply, tips 17 and 19 must be in "end-to-end" relationship, in order to provide the desired result. Of course, tip 19 of resilient flange 18 can overlap tip 17 of rigid upstanding hook 16, i.e. lie just inside of rigid upstanding hook 16 and such a configuration is intended to be within the definition of "end-to-end-relationship". The presence of resilient flanges 18 inhibits the accidental removal of product or product packaging when another item is being removed from clip strip 10 while allowing easy removal thereof when intended.

Resilient flanges 18 can be of any suitable configuration and size that permits operation as just described, however, a flat shape having its broadest surface parallel to backbone 12 has been found preferable in operation and use. It is also preferred as shown in FIG. 1 that tips 17 and 19 be in a directly facing, but spaced apart relationship for optimum operation.

The final element of clip strip 10 is upstanding flange 20 that permits attachment of product or pricing information. Upstanding flange 20 should be rigid and configured such that a tag or other device containing the required information can be inserted thereover, but not easily or accidentally removed. Accordingly, upstanding flange 20 preferably extends from the same side of backbone 12 as rigid upstanding hooks 16 and is shaped such that its extremity 21 extends over and in relatively close proximity to extremity 15 of backbone 12.

There has thus been described, a novel, low cost, integrally molded, one-piece clip strip device capable of supporting relatively heavy product items that concurrently provides a mechanism for inhibiting the accidental removal of a second item when a first is being selected.

As the invention has been described, it will be apparent to those skilled in the art that the same may be varied in many ways without departing from the spirit and scope of the invention. Any and all such modifications are intended to be included within the scope of the appended claims.

What is claimed is:

1. An integrally molded, one-piece clip strip merchandise display device comprising:

A) an elongated backbone having an upper extremity;

B) a mounting member extending from one side of the backbone in the vicinity of the upper extremity;

C) a plurality of rigid upstanding display hooks extending from and distributed vertically along the side of the backbone opposed to that from which the mounting member extends;

D) a plurality of resilient downstanding flanges extending downwardly from the backbone and each associated in end-to-end relationship with one of the upstanding display hooks wherein the plurality of downstanding flanges are more flexible than the upstanding display hooks; and E) near the upper extremity of and extending from the backbone an upstanding flange for the attachment of a device for presenting product information.

2. The clip strip merchandise display device of claim 1 wherein the backbone and the rigid upstanding hooks have a circular cross-section.

3. The clip strip merchandise display device of claim 2 wherein the diameter of the backbone and the rigid upstanding hooks is between about ⅛ inch and about ½ inch.

4. The clip strip merchandise display device of claim 2 wherein each resilient downstanding flange comprises a flat strip.

5. The clip strip merchandise display device of claim 1 fabricated from a polymeric material selected from the group consisting of nylon, polyethylene and polypropylene.

6. The clip strip merchandise display device of claim 1 wherein the rigid upstanding hooks have a radius of from about ¼" to about ¾".

7. The clip strip merchandise display device of claim 1 wherein the upstanding flange is rigid and has an outer extremity that overlaps the upper extremity of the backbone.

8. The clip strip merchandise display device of claim 1 wherein the mounting member extends downward at an angle of less than 90°.

9. An integrally molded, one-piece clip strip merchandise display device fabricated from a polymeric material and comprising:

A) an elongated backbone having an upper extremity;

B) a mounting member extending downward at an angle of less than about 90° from one side of the backbone in the vicinity of the upper extremity;

C) a plurality of rigid upstanding display hooks extending from and distributed vertically along the side of the backbone opposed to that from which the mounting member extends and having a radius of from about ¼ inch to about ¾ inch;

D) a plurality of flat resilient downstanding flanges extending downwardly from the backbone each associated in end-to-end relationship with one of the upstanding display hooks wherein the plurality of downstanding flanges are more flexible than the upstanding display hooks; and E) near the upper extremity of and extending from the backbone a rigid upstanding flange for the attachment of a device for presenting product information, said rigid upstanding flange having an outer extremity that overlaps the upper extremity of the backbone, and wherein the backbone and the rigid upstanding hooks are circular in cross section and have a diameter of between about ⅛ inch and about ½ inch.

* * * * *